United States Patent [19]

Hatakeyama

[11] 4,331,168

[45] May 25, 1982

[54] VANITY CASE

[75] Inventor: Yoshiharu Hatakeyama, Tokyo, Japan

[73] Assignee: Yoshida Industry Co., Ltd., Tokyo, Japan

[21] Appl. No.: 207,430

[22] Filed: Nov. 17, 1980

[30] Foreign Application Priority Data

Aug. 6, 1980 [JP] Japan ..... 55-110656[U]

[51] Int. Cl.[3] ..... A45D 40/00

[52] U.S. Cl. ..... 132/79 G; 292/83; 292/DIG. 50

[58] Field of Search ..... 132/79 G, 79 F; 292/83, 292/86, 170, DIG. 37, DIG. 50

[56] References Cited

U.S. PATENT DOCUMENTS

| | | | |
|---|---|---|---|
| 1,632,863 | 6/1927 | Weber | 292/83 |
| 2,035,832 | 3/1936 | Parkin | 292/DIG. 50 |
| 3,537,552 | 11/1970 | Noble | 132/79 F |

*Primary Examiner*—Robert A. Hafer

*Attorney, Agent, or Firm*—Wenderoth, Lind & Ponack

[57] ABSTRACT

A cover member of a vanity case is provided with a cavity extending therein from the front end thereof. A slider element has an inner end portion slidably inserted into the cavity, and an enlarged outer end portion thereof located closely adjacent to the front end of a receptacle member of the vanity case in a closed position of the cover member. The enlarged outer end portion is arranged to force down the receptacle member to release the snap engagement between the cover and receptacle members when the slider element is pushed inwardly.

5 Claims, 8 Drawing Figures

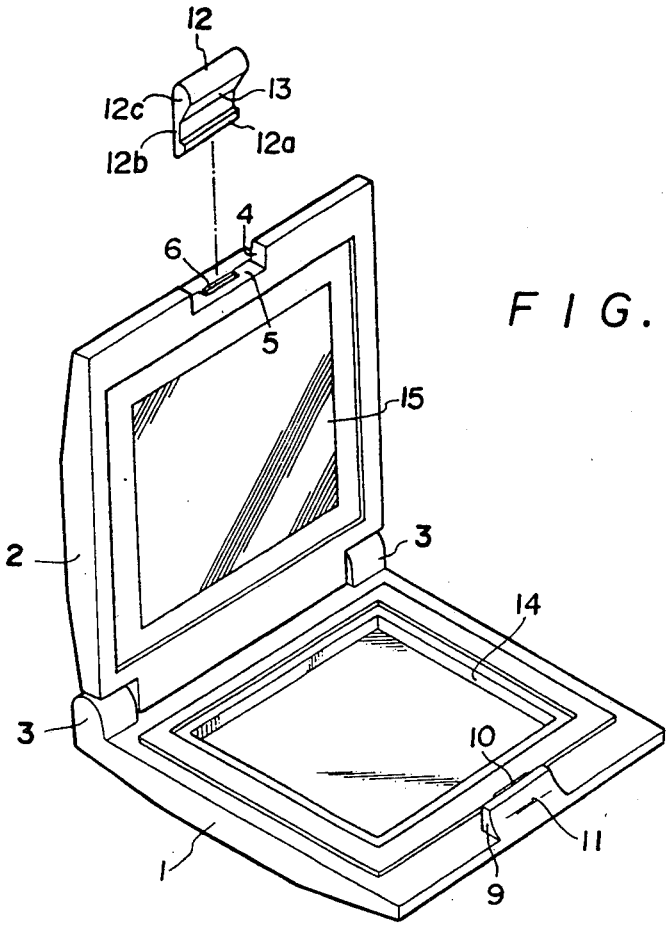
FIG. 1
FIG. 3
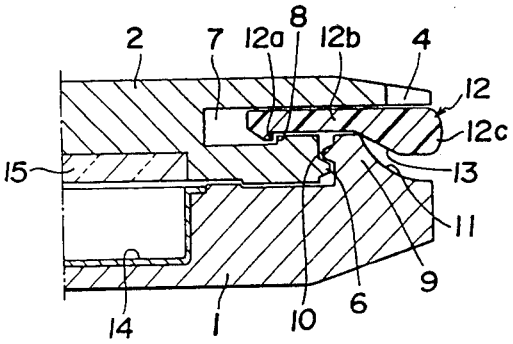
FIG. 4
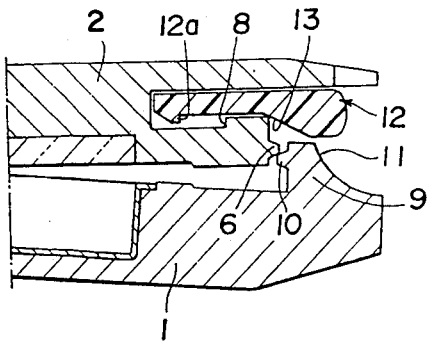

VANITY CASE

BACKGROUND OF THE INVENTION

This invention relates to an improvement of a vanity case having a receptacle member and a cover member hinged with each other and arranged to be latched by snap engagement of an elastic latch tongue formed on one of the members with a protrusion formed on the other member.

In a known vanity case, such as a compact case, of the type set forth above, the elastic latch tongue as well as the protrusion are integrally formed with the cover and receptacle members by plastic molding. Such elastic latch tongue and protrusion have to be formed to very precise dimensions because, if the engagement between the latch tongue and the protrusion is weak, the cover member of the vanity case will open accidentally. On the other hand, if the engagement therebetween is strong, a relatively strong force has to be exerted to open the cover member, thereby causing trouble to a user. Accordingly, when molding the cover and receptacle members, the utmost attention is paid to the accuracy of the dimensions of the latch tongue and protrusion. However, inferior vanity cases having defective dimensions of the latch tongue and protrusion have been formed inevitably at a relatively high percentage.

As an improvement of the defects set forth above, the present inventor has proposed in U.S. patent application Serial No. 890,957 to provide a slider element which releases the snap engagement between the latch tongue and the protrusion when pushed in the horizontal direction. This structure has remarkable advantages that the above-mentioned engagement can be released very easily by a small pushing force, so that the latch tongue as well as the protrusion can be formed to engage strongly with each other without the necessity of dimensional accuracy as required in the conventional vanity case. However, in the above proposed vanity case, since the slider element is provided through the front end of the receptacle member, the slider element comes close to the palm of the hand when the vanity case is placed on a user's hand in a usual manner, so that the pushing operation of the slider element for opening the cover member has been incovenient.

Accordingly, an object of the present invention is to improve the above drawbacks and, thereby, to provide a vanity case including a cover member which can be opened very easily by placing the vanity case on a palm of the hand of a user.

Another object of the present invention is to provide a vanity case in which a slider element for opening the cover member is snugly provided in the cover member without spoiling the external appearance thereof.

A further object of the present invention is to provide a vanity case in which a structure for opening the cover member is very simple in construction and assembly and reliable in operation.

SUMMARY OF THE INVENTION

A vanity case according to the present invention comprises a receptacle member for containing cosmetic material therein, a cover member hinged with the receptacle member at the rear end thereof, a first latching member integrally formed with the receptacle member, and a second latching member integrally formed with the cover member, the first and second latching members being adapted to be engaged with each other by snap action when the receptacle member is closed by the cover member. The cover member is provided with a cavity extending therein from the front end thereof, into which cavity is slidably inserted the inner end portion of a slider element. The outer end portion of the slider element is enlarged and arranged to be located closely adjacent to the front end of the receptacle member in a closed position of the cover member and also is arranged to force down the receptacle member to release the engagement between the first and second latching members when the slider element is pushed inwardly.

Preferably, the first latching member is provided on a nose projecting upwardly from the front end of the receptacle member, while the second latching member is provided on an end surface of a recess formed in the front end of the cover member. The nose is formed to enter into the recess when the receptacle member is closed by the cover member. The cavity is formed through the upper part of the recess. The slider element has a lower inclined surface which abuts against the upper end of the nose and which forces down the nose when the slider element is pushed inwardly.

Further objects and features of the present invention will become apparent from the following detailed description of preferred embodiments thereof when taken in conjunction with the accompanying drawings, in which:

BRIEF DESCRIPTION OF THE DRAWINGS

FIG. 1 is a perspective view showing a vanity case, i.e. compact case, according to a first embodiment of the present invention with a cover member thereof being in an open position, wherein a slider element for unlatching the engagement between the cover member and a receptacle member is shown exploded before assembly thereof, FIG. 3 is an enlarged fragmentary sectional view of the compact case shown in FIG. 2 with the slider element being in an inoperative position, FIG. 4 is an enlarged fragmentary sectional view of the compact case shown in FIG. 2 with the slider element being in an operated position.

DETAILED DESCRIPTION OF THE INVENTION

Figure 2:
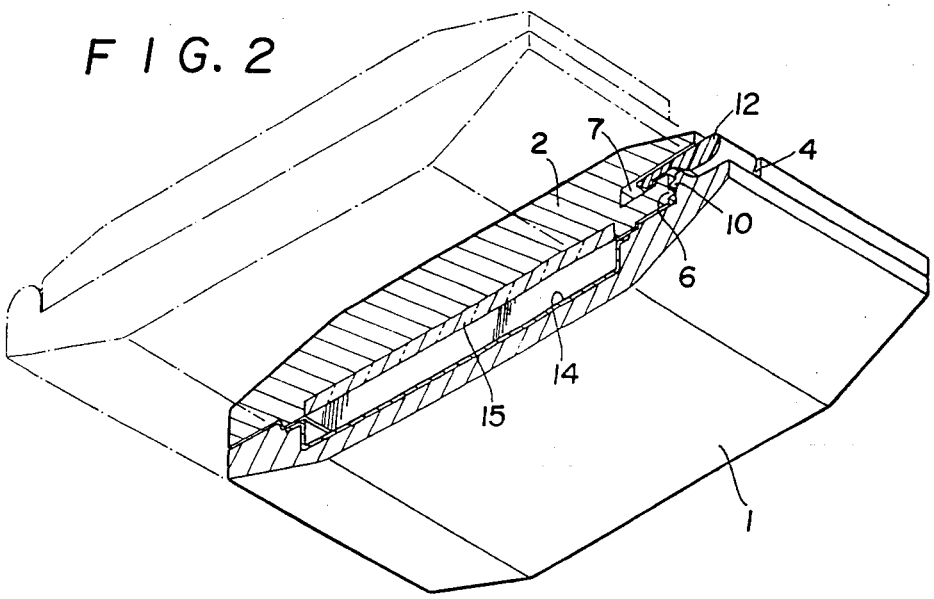
FIG. 2 is a partially sectioned perspective view showing the compact case according to the first embodiment of the present invention with the cover member thereof being in a closed position after assembly of the slider element.

Referring now to a first embodiment of the present invention shown in FIGS. 1 to 5, a plastic vanity case, i.e. compact case, of the present invention comprises a receptacle member or part 1 and a cover member 2 connected with each other by a hinge 3 along the rear ends thereof. The front end of the cover member 2 is cut out rectangularly at the center part thereof to provide a recess 4. The end wall 5 defining the recess 4 is provided with a protrusion 6 integrally formed thereon. The upper part of the recess 4 is deeply concaved into the cover member to form a cavity 7 as shown in FIGS. 2 to 4. The upper wall defining the cavity 7 has a flat surface, but the lower wall defining it has a step 8 thereon.

The receptacle part 1 has an integral nose 9 vertically extending from the front end thereof. The nose 9 has an elastic latch tongue 10 on the inner surface thereof, an the outer surface 11 of nose 9 is inclined. This nose 9 enters into the recess 4 of the cover member 2 when the latter is partially closed, and the elastic latch tongue 10 on the nose is engaged with the protrusion 6 in the recess by snap action, thereby completely closing the receptacle part by the cover member.

According to the present invention, a plastic slider element designated by reference numeral 12 is slidably provided in the cavity 7 formed at the upper part of the recess 4 in the cover member 2. The slider element 12 comprises a rear or inner hook portion **12*a*, an intermediate flat portion 12*b*, and a front or outer enlarged head portion 12*c*. The rear hook portion 12*a* has a thickness slightly larger than the gap at the open end of the cavity 7. However, since the hook portion 12*a* a made of plastics and is elastic, the slider element can forcedly be pressed into the cavity 7 through the gap during assembly. After assembly of the slider element 12, the hook portion 12*a* entered into the enlarged inner space of the cavity can elastically restore to its original shape and then will be engagable with step 8 in the cavity 7, so that the slider element 12 cannot be removed from the cavity. The intermediate flat portion 12*b* of the slider element 12 has a thickness slightly smaller than the gap of the cavity 7 to allow smooth sliding of the slider element 12. The front head portion 12*c* of the slider element 12 is enlarged much more than the gap of the cavity 7, thereby providing an inclined lower surface section 13 between the enlarged front end and the intermediate flat portion 12*b*. This inclined lower surface section 13 is arranged to lightly contact the upper end of the nose 9 on the receptacle part 1 when the cover member 2 is closed upon the receptacle part 1, as shown in FIG. 3**.

Further provided in the compact case are a concave tray 14 embedded in the receptacle part 1, and a mirror 15 attached to the inner surface of the cover member 2.

Reference is now made to the manner of use of the present compact case. In the closed position of the cover member 2 shown in FIG. 3 where the latch tongue 10 on the receptacle part 1 is engaged with the protrusion 6 on the cover member 2, when the slider element 12 is pushed inwardly by a finger of a user, the slider element slides inwardly along the cavity 7. At this time, the inclined lower surface section 13 on the slider element 12 acts against the upper end of the nose 9 on the receptacle part to press down the latter. Thus, the engagement between the latch tongue 10 on the receptacle part 1 and the protrusion 6 on the cover member 2 is released as shown in FIG. 4. It should be noted here that when the slider element 12 is pushed inwardly as set forth above, not only the engagement between the latch tongue 10 and the protrusion 6 is released but also the cover member 2 is partially opened from the receptacle part 1. The degree of such opening of the cover member 2 can be determined as desired by arranging the angle of the lower inclined surface section 13 of the slider element and/or the length of the lower inclined surface section 13 along which the upper end of the nose 9 slides. After the cover member 2 is partially opened from the receptacle part 1, the cover member can be opened freely to a desired angle to use cosmetic material in the tray 14 and mirror 15 as usual.

Figure 5:
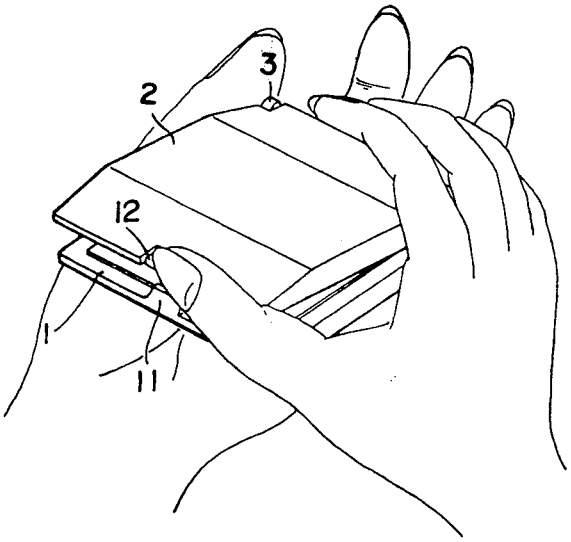
FIG. 5 is a perspective view showing the manner of use of the compact case according to the first embodiment of the present invention.

As will be understood from the description of the first embodiment of the present invention, since the slider element is provided at the front end of the cover member, it is very easy to operate the slider element by placing the compact case on the palm of a user's hand, as shown in FIG. 5. Also, once the slider element is pushed inwardly, the cover member is partially opened by disengagement of the latch tongue and protrusion and is not closed until the cover member is pressed down as usual. Therefore, it is very convenient to freely open the cover plate to a desired angle. Furthermore, in the embodiment set forth above, the front end of the slider element can be arranged to align with the front end of the cover member and not to project forwardly, so that the external appearance of the compact case is not spoiled by the slider element.

Figure 6:
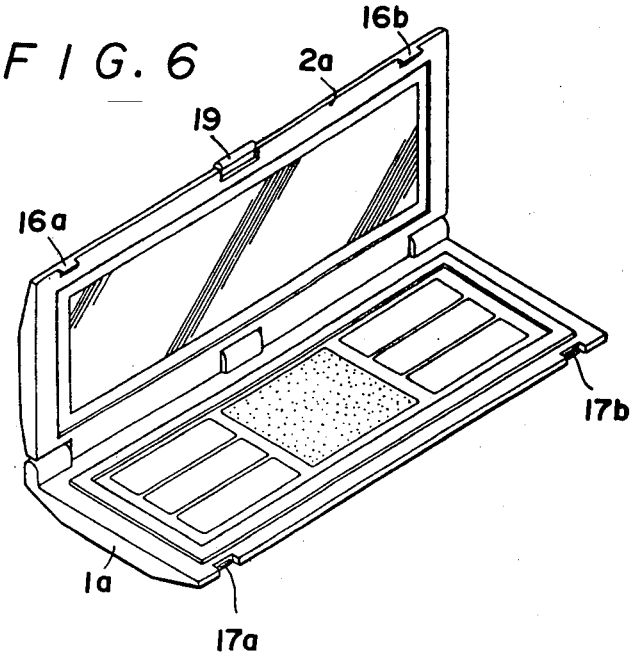
FIG. 6 is a perspective view showing another compact case according to a second embodiment of the present invention.
Figure 7:
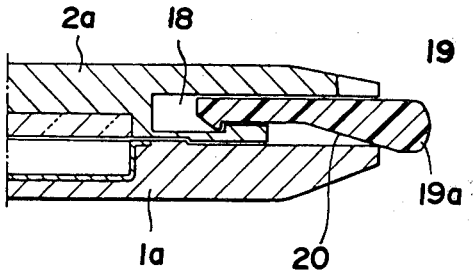
FIG. 7 is an enlarged fragmentary sectional view of the compact case shown in FIG. 6 with the slider element being in an inoperative position.
Figure 8:
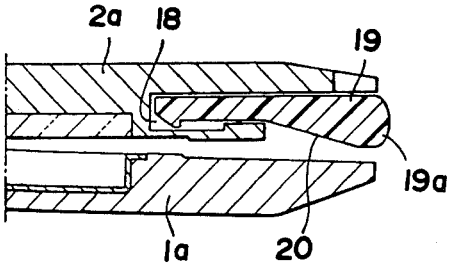
FIG. 8 is an enlarged fragmentary sectional view of the compact case shown in FIG. 6 with the slider element being in an operated position.

Reference is now made to a second embodiment of the present invention shown in FIGS. 6 to 8. In this second embodiment, a laterally elongated compact case is provided in which two latch tongues **16*a*–16*b* are integrally formed with a cover member 2*a* and downwardly extend therefrom at both side portions thereof. These latch tongues 16*a*–16*b* are arranged to engage with protrusions 17*a*–17*b* formed on recessed walls at the front end of a receptacle part 1*a* when the cover member 2*a* is closed. The central front end of the cover member 2*a* has an inwardly recessed cavity 18 in which a slider element 19 of the same type as set forth in the first embodiment is slidably inserted. Different from the first embodiment, in the closed position of the cover member, the enlarged front end 19*a* of the slider element 19 projects forwardly beyond the front end of the receptacle part 1*a* and the lower inclined surface section 20 thereof abuts against the front edge of the receptacle part 1*a* as shown in FIG. 7**.

When the slider element 19 is pushed inwardly from the closed position shown in FIG. 7, the lower inclined surface section 20 of the slider element 19 acts against the front edge of the receptacle part to lower the same, so that the engagements between the latch tongues **16*a*–16*b* and the protrusions 17*a*–17*b* are released and that the cover member 2*a* is partially separated from the receptacle part 1*a* as shown in FIG. 8**.

Other structure and operation of the second embodiment are substantially the same as described in the first embodiment, so that the detailed description thereof is omitted herein.

As in the case of the first embodiment, the compact case of the second embodiment has such advantages that the cover member can be opened very easily and conveniently by placing the compact case on the palm of a user's hand and that, once the slider element is pushed forwardly, the cover member is partially opened and not closed even after removing the pushing force from the slider element, thereby making it very easy to freely open the cover member to any desired angle as usual.

Although the present invention has been described with reference to the preferred embodiments thereof, many modifications and alterations may be made within the spirit of the present invention. For example, the present invention can be applied to many kinds of vanity cases other than a compact case.

What is claimed is:

1. A vanity case comprising:

a receptable member molded of synthetic resin material for containing a cosmetic material;

a cover member molded of synthetic resin material;

said receptable and cover members being hinged together at respective rear ends thereof;

said cover member having formed therein a cavity extending rearwardly from a front end of said cover member;

a first latching protrusion integrally molded with said receptable member;

a second latching protrusion integrally molded with said cover member;

said first and second latching protrusions being engaged with each other by snap action when said receptable member is closed by said cover member, thereby maintaining said cover member in a closed position with respect to said receptacle member; and a slider element having an inner end portion and an outer end portion, said inner end portion being slidably received in said cavity, said outer end portion being positioned closely adjacent the front end of said receptacle member in said closed position of said cover member, said slider element having an outer end surface aligned with a front surface of said cover member when said cover member is in said closed position, and said outer end portion of said slider element including means for, upon inward movement of said slider element, forcing said receptable member away from said cover member and releasing engagement between said first and second latching protrusions, thereby moving said cover member to an open position.

2. A vanity case as claimed in claim 1, wherein said cover member has formed in said front end thereof a recess, said cavity extending through an upper portion of said recess, said receptable member includes a nose portion projecting from a front end thereof, said nose portion extending into said recess, said first latching protrusion is formed on said nose portion, said second latching protrusion is formed on a surface defining said recess, and said forcing and releasing means comprises a surface of said outer end portion of said slider element, said surface being inclined to the direction of movement of said slider element and abutting said nose portion.

3. A vanity case as claimed in claim 2, wherein said first latching protrusion faces rearwardly, and said second latching protrusion faces forwardly.

4. A vanity case as claimed in claims 1 or 2, wherein said cavity includes an open end portion of a size less than the size of the remainder of said cavity and defining therewith a step, said inner end portion of said slider element includes an inner resilient hook portion of a size larger than said open end portion and adapted to be forcably pressed therethrough and to then engage said step, thus preventing removal of said slider element.

5. A vanity case as claimed in claim 1, wherein said forcing and releasing means comprises a surface of said outer end portion of said slider element, said surface being inclined to the direction of movement of said slider element and abutting said receptable member.

* * * * *